US005185611A

United States Patent [19]

Bitter, Jr.

[11] Patent Number: 5,185,611

[45] Date of Patent: Feb. 9, 1993

[54] COMPACT ANTENNA ARRAY FOR DIVERSITY APPLICATIONS

[75] Inventor: Charles R. Bitter, Jr., Scottsdale, Ariz.

[73] Assignee: Motorola, Inc., Schaumburg, Ill.

[21] Appl. No.: 732,017

[22] Filed: Jul. 18, 1991

[51] Int. Cl.[5] ..... H01Q 1/24

[52] U.S. Cl. ..... 343/702; 343/770

[58] Field of Search ..... 343/702, 767, 770, 771, 343/807, 795

[56] References Cited

U.S. PATENT DOCUMENTS

| | | | |
|---|---|---|---|
| 3,836,976 | 9/1974 | Monser et al. | 343/795 |
| 4,001,834 | 1/1977 | Smith | 343/795 |
| 4,843,403 | 6/1989 | Lalezari et al. | 343/767 |
| 4,853,704 | 8/1989 | Diaz et al. | 343/767 |
| 5,036,335 | 7/1991 | Jairam | 343/767 |
| 5,070,340 | 12/1991 | Diaz | 343/767 |
| 5,081,466 | 1/1992 | Bitter, Jr. | 343/767 |
| 5,081,467 | 1/1992 | Homer | 343/795 |

*Primary Examiner*—Michael C. Wimer
*Assistant Examiner*—Tan Ho
*Attorney, Agent, or Firm*—Val Jean F. Hillman

[57] ABSTRACT

An antenna array includes planar top and bottom conductive covers. Radiating elements each comprising a tapered notch antenna formed on a metallized dielectric board are disposed between the covers. Conductive septums are interleaved with the radiating elements. The top and bottom covers together with the septums define enclosures that house each of the radiating elements. At least some of the antenna boards and septums are gradually curved to reorient the radiated energy towards desired geographic areas.

10 Claims, 1 Drawing Sheet

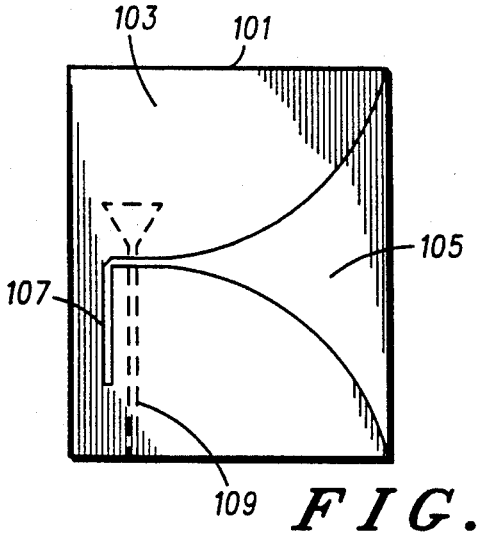
FIG. 1
FIG. 4
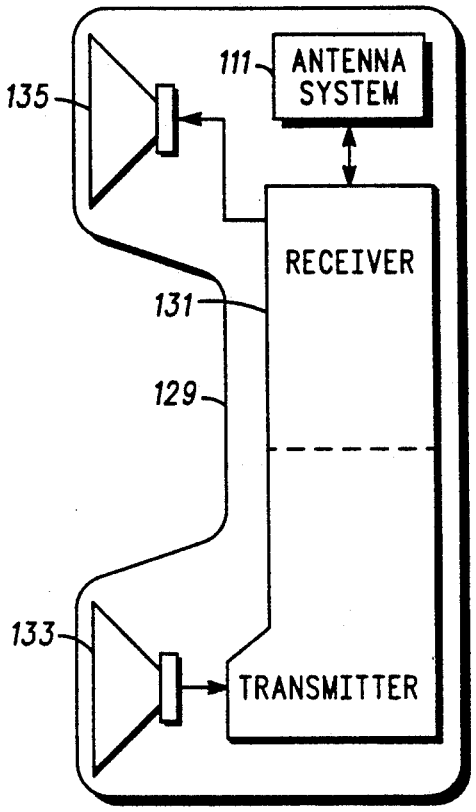
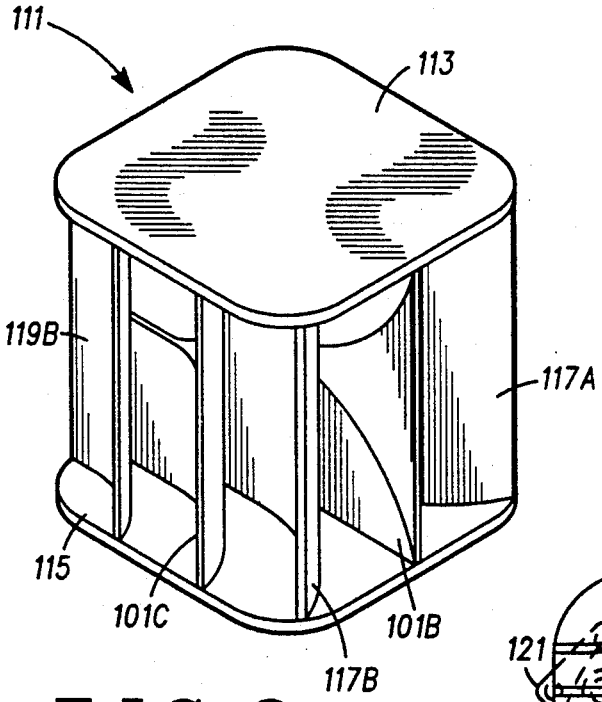
FIG. 2
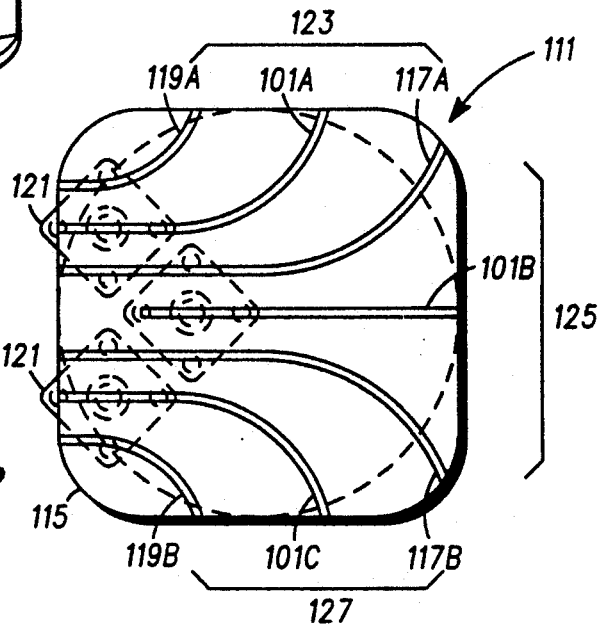
FIG. 3

COMPACT ANTENNA ARRAY FOR DIVERSITY APPLICATIONS

BACKGROUND OF THE INVENTION

The present invention is directed to a diversity antenna system having a plurality of adjacent radiation apertures with different directions of peak radiation. Each radiation aperture preferably consists of an open-ended notch radiator formed as part of a dielectric board separated from the other radiators by conductive septums that cooperate with conductive top and bottom covers to define nonresonant enclosures.

Tapered notch antennas excited by a microstrip feed line are known in the art. The front side of a circuit board has a metallized surface with a tapered notched area etched away to expose the dielectric substrate. The back side of the dielectric substrate has a metallized strip that functions as a microstrip feed line.

The type of diversity discussed herein is spatial diversity, i.e. physically separated antennas. Consider that at a given instant of time the induced signals in each of the physically separated antennas will have different magnitude and phase relative one antenna to the others depending upon the physical spatial separation and the directional characteristics of each antenna with respect to the impinging wave front. Further, reciprocity exists for the system.

Portable communications equipment such as a hand held telephone typically uses a resonant monopole antenna. This antenna produces an omni-directional radiation pattern with peak gain perpendicular to the axis of the monopole. As operating frequencies used by this equipment increase, the number of objects in the environment that can function as a reflector of the radiated energy increases. This occurs because as frequencies increase the wavelengths decrease, and to be a reflector of a radiated wave a reflective object must be at least a substantial fraction of the wavelength. The same signal arriving at an antenna as two or more out of phase signals is known as multipath distortion. Reflections of a signal received out of phase relative to other reflected signals or to a directly received signal give rise to multipath distortion problems. In order to minimize multipath distortion and generally improve the quality of reception at higher operating frequencies, a need exists for an improved antenna suited for use on portable communications equipment which can utilize spatial diversity for improved performance.

SUMMARY OF THE INVENTION

It is an object of the invention to provide an improved compact diversity antenna suited for use on portable communications equipment.

In an illustrative embodiment of a diversity antenna system in accordance with the present invention, a plurality of tapered notch antennas preferably fabricated on printed circuit boards are separated by conductive septums and enclosed by conductive top and bottom covers. The septum(s) and notch antenna(s) are desirably curved to define compact antenna feed ports and antenna apertures directed at different geographic areas.

BRIEF DESCRIPTION OF THE DRAWINGS

FIG. 1 shows an embodiment of a shortened tapered notch antenna with feed structure suited for use in the diversity antenna of the present invention.

FIG. 2 is a perspective view of an embodiment of a compact diversity antenna system in accord with the present invention.

FIG. 3 shows a top view of the antenna system of FIG. 2 with the top cover removed.

FIG. 4 shows a pictorial representation of a portable two-way radio incorporating an embodiment of the present invention.

DESCRIPTION OF A PREFERRED EMBODIMENT

FIG. 1 illustrates a preferred embodiment of a reduced length notched antenna formed on a printed circuit board (PCB) 101. The front surface of the printed circuit board as shown in FIG. 1 includes metallized area 103 and non-metallized area 105. A metallized notched portion 107 of area 105 extends perpendicular to the axis of the flare thereby permitting the length of board 101 to be shortened. A conductive feed line 109 is shown disposed on the rear surface of board 101 and constitutes the only metallized area on that side of the board. Although the feed line 109 is shown exiting the board 101 at the bottom, it will be apparent to those skilled in the art that this line could exit either at the top or the left end of the board. Preferably the printed circuit board 101 is sufficiently resilient to enable it to be gradually curved as will be explained for use in the antenna system described below.

FIGS. 2 and 3 illustrates an embodiment of a compact diversity antenna system 111 in accordance with the present invention. It includes a substantially planar conductive top 113 and a substantially planar conductive bottom 115 spaced apart from and parallel to the top. In the illustrative embodiment three tapered notched antennas 101A, 101B, and 101C formed generally in accordance with FIG. 1 are disposed between and perpendicular to the conductive top and bottom covers. The board containing notch antenna 101B is substantially planar and has opposing edges which are contiguous to the bottom and top covers, respectively. Preferably the axis of taper is parallel to the covers and spaced equidistant between them. Notch antennas 101A and 101C are similarly disposed except that each is gradually bent, as best seen in FIGS. 2 and 3, to diverge away from notch antenna 101B so that the outwardly extending distal edges of 101A and 101C define an angle approximately 90° relative to antenna 101B.

Conductive septums (walls) 117A and 117B have edges which contiguously engage the top and the bottom covers. The septums are formed from a substantially planar sheet of metal or PCB and are increasingly curved toward their distal edges so as to diverge from notch antenna board 101B. They are substantially equally spaced horizontally between notch antenna 101B and the curved notched antennas 101A and 101C, respectively. Similarly, curved conductive septums 119A and 119B are horizontally spaced on the other side of notched antennas 101A and 101C substantially the same distance from these antennae as septums 117A and 117B, respectively. Three coaxial connectors 121 each have center conductors which engage one feed line, such as feed line 109 as shown in FIG. 1, to couple energy separately to each of the notched antennas 101A, 101B, and 101C. The ground portions of the coaxial connector are coupled to the conductive bottom 115. The antenna boards are substantially parallel to the septums at the feed line near the end of the boards opposite the edge with maximum taper. This convenient symmetry simplifies construction. As will be apparent to those skilled in the art other methods of physically connecting the feed line to the system can be used.

Three radiation apertures 123, 125, and 127 are defined each having peak radiation patterns substantially 90° relative to each other. It should be noted that the three radiation apertures do not constitute nor function as a wave guide horn antenna since the respective cross sections and length dimensions of the enclosures defined by the septums and top and bottom covers will not support a closed wave guide propagation mode at the design frequency. Thus the enclosures are open ended and non-resonant. Each of the three antenna apertures is driven by a linearly polarized tapered notch antenna with its radiating aperture at the board's edge. The radiating aperture resembles a vertical dipole with the phase center at the midpoint, i.e. at the axis of taper. The illustrative diversity antenna embodiment provides horizontal coverage of 270° in three adjacent 90° segments.

It will be apparent to those skilled in the art that different ranges of horizontal coverage could be obtained by disposing an appropriate plurality of antenna apertures in accordance with the present invention which divides a predetermined range of coverage into a desired number of segments. Such embodiments contain at least M radiating elements or antennas, where M is an integer $\geqq 2$, and at least N conductive interleaved septums, where N is an integer $\geqq 3$. In the illustrated example, $M=3$, $N=4$. If M is an even number such as 2, the center element (101B in FIG. 3) will be a septum and the 2 curved diverging notch antenna boards will be disposed equidistant between it and outer curved septums 119A, 119B.

FIG. 4 illustrates a hand held two-way portable radio or telephone 129 which includes a receiver and transmitter disposed on printed circuit board 131, a microphone 133, and a speaker 135. The receiver/transmitter is preferably coupled to an antenna system 111 in accordance with the present invention which is oriented with notch antenna 101B providing maximum radiation opposite and away from speaker 135. One of the three different antennas is utilized dependent upon which provides the best communications with the other RF communications equipment. The antenna system according to the present invention provides an advantage that maximum radiation is either away from the user or parallel to the user depending upon the antenna utilized.

It is known to those skilled in the art that various techniques exist for selecting the best antenna for use. For example, each of the antennas may sequentially receive a signal and utilize maximum signal strength to make the determination. Alternatively, a more sophisticated test based on signal quality can be utilized for antenna selection instead of or supplementary to signal strength measurements.

Although an embodiment of the present invention has been described and shown in the drawings, the scope of the invention is defined by the claims which follow.

I claim:

1. An antenna array comprising:

substantially planar conductive top and bottom covers;

at least M radiating elements disposed between said top and bottom covers, where M is an integer equal to or greater than two, said radiating elements each comprising a tapered notch antenna formed on a metallized dielectric board, each notch antenna having an axis about which the taper is formed;

means for separately coupling radio frequency signals to each of said radiating elements;

at least N conductive septums, having first and second edges connected to said top and bottom covers, interleaved with said radiating elements so that each radiating element is separated from adjacent radiating elements by a septum, N being an integer greater than or equal to three, any two adjacent septums forms a conductive enclosure that houses a radiating element;

each of said conductive enclosures being oriented to direct radiated energy from the corresponding radiating element to a different geographic region; and at least two of said radiating elements each having a curve in a plane perpendicular to said notch antenna axis so that said notch antennas remain equidistant from the top and bottom covers and have distal edges that diverge, said curve being disposed between the notch antenna distal edge and a point where the coupling means couples radio frequency signals to said radiating element.

2. The antenna array according to claim 1 wherein said enclosures are open ended non-resonant enclosures.

3. The antenna array according to claim 1 wherein at least two of said septums comprise conductive sheets that are curved to generally follow the curves of said notch antennas and define enclosures with distal open ends that are wider than the enclosures adjacent to said coupling means.

4. The antenna array according to claim 3 wherein M is three and N is four thereby defining three conductive enclosures each directing radiated energy to one of three adjacent 90 degree geographic regions.

5. The antenna array according to claim 1 wherein said dielectric boards and said septums are substantially parallel to one another at a point adjacent to said coupling means.

6. A portable two-way radio comprising:

a transmitter that generates a radio frequency (RF) signal;

a receiver that demodulates a received RF signal;

an antenna array that radiates and receives said RF signals, said array including:

substantially planar conductive top and bottom covers;

at least M radiating elements disposed between said top and bottom covers, where M is an integer equal to or greater than two, said radiating elements each comprising a tapered notch antenna formed on a metallized dielectric board, each notch antenna having an axis about which the notch is formed;

means for separately coupling RF signals to each of said radiating elements;

at least N conductive septums, having first and second edges that are connected to said top and bottom covers, interleaved with said radiating elements so that each radiating element is separated from adjacent radiating elements by a septum, N being an integer equal to or greater than three, any two adjacent septums forms an open ended nonresonant conductive enclosure that houses a radiating element;

each of said open ended non-resonant conductive enclosures being oriented to direct radiated energy from the corresponding radiating element to a different geographic region; and at least two of said M radiating elements each having a curve in a plane perpendicular to said notch antenna axis so that said notch antennas remain equidistant from the top and bottom covers and have distal ends that diverge, said curve being disposed between the notch antenna's distal end and a point where the coupling means couples RF signals to said radiating element.

7. The radio according to claim 6 wherein said enclosures are open ended non-resonant enclosures.

8. The radio according to claim 6 wherein at least 2 of said septums comprise conductive sheets that are curved to generally follow the curves of said notch antennas and define enclosures with distal open ends that are wider than the enclosures adjacent to said coupling means.

9. The radio according to claim 7 wherein M is three and N is four, thereby defining three conductive enclosures each directing radiated energy to one of three adjacent 90 degree geographic regions.

10. The radio according to claim 6 wherein said dielectric boards and septums are substantially parallel to one another at a point adjacent to said coupling means.

* * * * *